United States Patent [19]

Bland

[11] Patent Number: 4,641,014

[45] Date of Patent: Feb. 3, 1987

[54] HAND-HELD HAIR DRYER HAVING HOUSED RADIO RECEIVER

[76] Inventor: Todd A. Bland, 5729 S. 152nd Ave., Omaha, Nebr. 68137

[21] Appl. No.: 724,595

[22] Filed: Apr. 18, 1985

[51] Int. Cl.[4] ..... H05B 1/00; H04B 1/08; A45D 20/42; A45D 20/12

[52] U.S. Cl. ..... 219/370; 34/90; 34/97; 34/243 R; 132/9; 219/361; 219/366; 219/472; 455/344; 455/351

[58] Field of Search ..... 219/369, 370, 373, 472, 219/473, 366, 367, 368, 361; 34/96–101, 243 R, 90; 132/9, 11 R; 455/344, 351; D14/72

[56] References Cited

U.S. PATENT DOCUMENTS

| | | | |
|---|---|---|---|
| D. 206,462 | 12/1966 | Petrusek | 455/344 X |
| D. 252,996 | 9/1979 | Woolley | D14/72 |
| 2,927,995 | 3/1960 | Francis | 455/344 X |
| 2,966,550 | 12/1960 | Goldberg et al. | 455/344 X |
| 3,165,991 | 1/1965 | Yoshida | 455/344 X |
| 3,610,881 | 10/1971 | Stewart | 219/370 |
| 4,035,731 | 7/1977 | Dixon | 455/351 X |
| 4,279,342 | 7/1981 | Van Pelt | 455/351 X |
| 4,297,564 | 10/1981 | Bartolac | 219/370 X |

FOREIGN PATENT DOCUMENTS

| | | | |
|---|---|---|---|
| 486623 | 11/1953 | Italy | 219/370 |
| 981010 | 1/1965 | United Kingdom | 219/370 |

*Primary Examiner*—A. Bartis

[57] ABSTRACT

A hand-held hair dryer includes an elongated tubular barrel containing an electric heating element and extending from a hollow volute portion provided with a rotatable impeller producing a flow of air through the barrel. A tubular handle is secured to the volute portion by an elongated rectangular cross-section base portion extending generally transversely to the longitudinal axis of the barrel and having parallel opposed base-sides provided with mirror image C-shaped indentations. A conventional portable radio receiver provided with a speaker and controls is stably seated and cradled within the opposed indentations of the base-sides with the speaker and controls positioned in registry with windows formed in the base-sides to enable the user of the dryer to relieve the tedium of hair drying by listening to music or other entertainment from the housed radio receiver.

2 Claims, 5 Drawing Figures

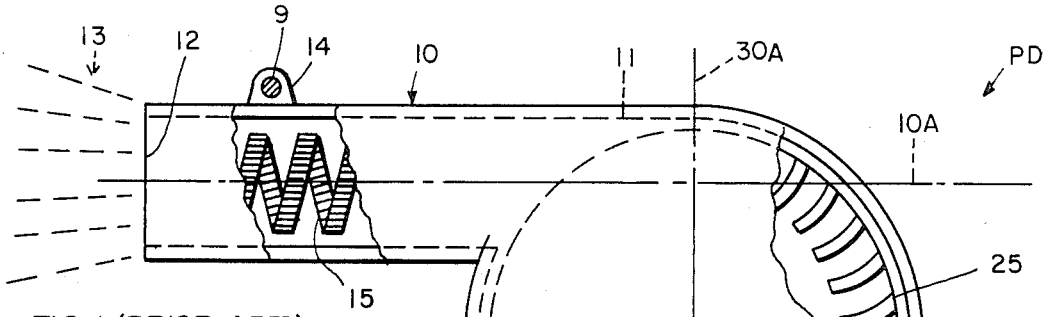
FIG. 1 (PRIOR ART)
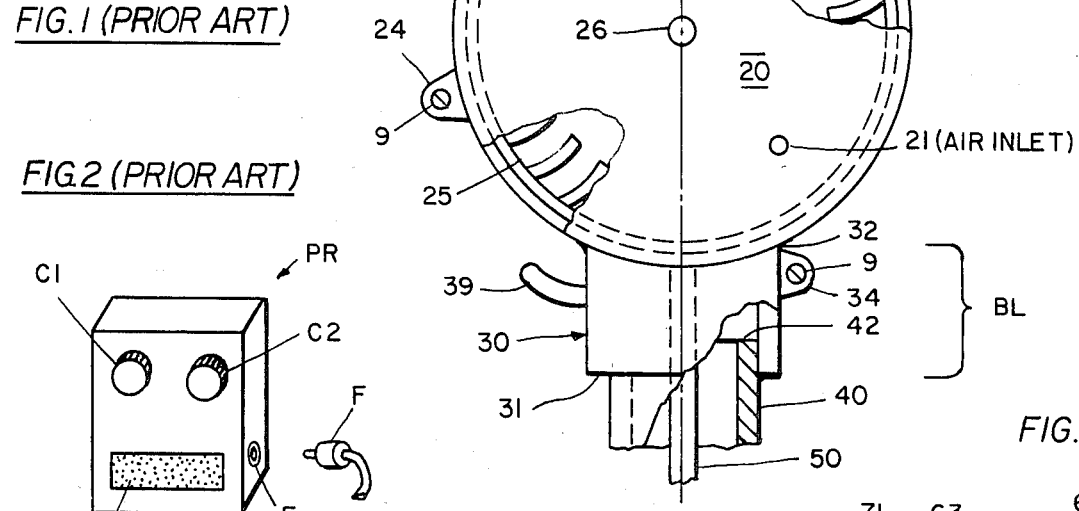
FIG. 2 (PRIOR ART)
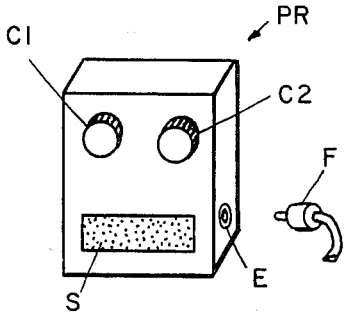
FIG. 5
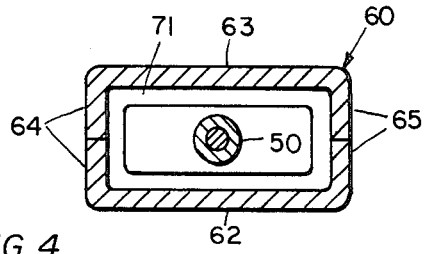
FIG. 3
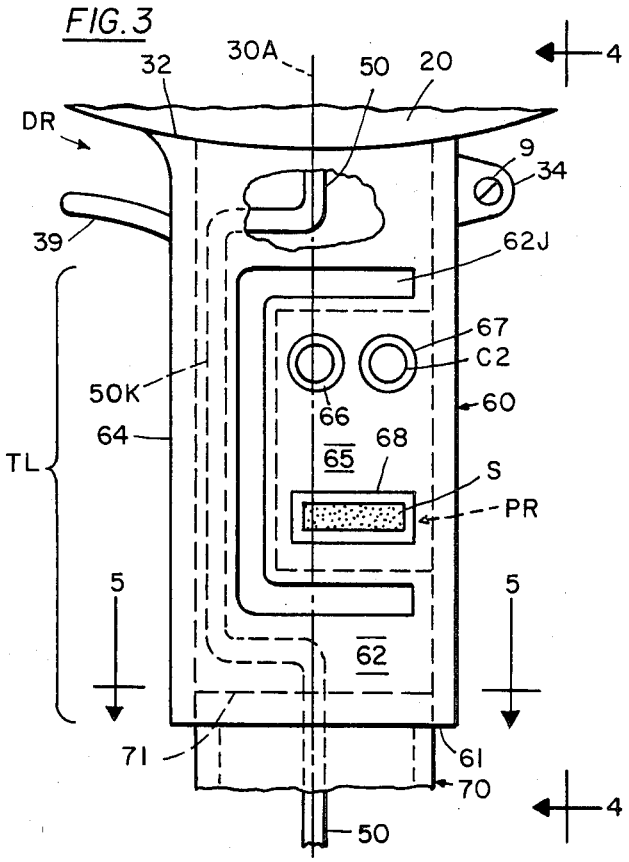
FIG. 4
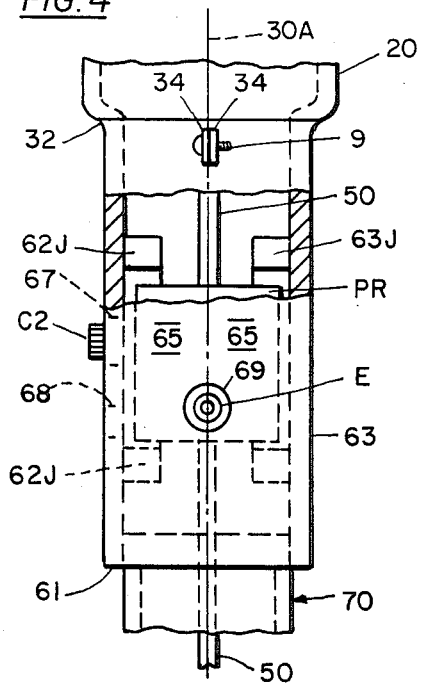

HAND-HELD HAIR DRYER HAVING HOUSED RADIO RECEIVER

BACKGROUND OF THE INVENTION

Drawing FIG. 1 is a side elevational view (partly in section) of a typical conventional hand-held hair dryer embodiment "PD" generally comprising: a heating element 15 located between the outlet-end (12) and the inlet-end (11) of a laterally extending cylindrically tubular barrel 10; a rotatable air impeller 25 located within a hollow volute 20 and adapted to draw ambient air through an air-intake port (21) and propel such air into the inlet-end 11 of communicating barrel 10; and a longitudinally extending cylindrically tubular base portion 30 the lower end (31) of which is provided with a longitudinal handle means (e.g. 40). The tubular barrel and base portion, and the hollow volute, are customarily collectively provided in two unitary sub-parts and removably joined (as by screws 9). In the latter regard, each of the semi-circular halves of barrel 10 include abutting ears 14 joined by screw 9, each of the semi-circular halves of base 30 include abutting ears 34 joined by another screw 9, and each of the dish-like halves of volute 20 include abutting ears 24 joined by yet another screw 9.

Conventionally, the heating element (e.g. 15) is of the high-resistance electrical conductor type which helically surrounds the barrel central axis 10A between barrel ends 11 and 12. Electrical power to the heating element, and to an electrically motorized type impeller (25), is suppliable through an electrical cord 50 extending along the central axis 30A of tubular base portion 30 and interruptable by an on-off or similar electrical switch 39 carried by base portion 30. "BL" indicates the relatively short longitudinal length between the base portion ends 31 and 32. The axle (26) for rotatable air impeller 25 is journalled in volute 20. The handle embodiment 40 takes a cylindrical tubular form surrounding said axis 30A and said cord 50, there being a circularly tubular upper end 42 that is tightly surrounded by circularly tubular base portion 30 and thereby attached thereto. In the latter regard, the handle upper end 42 is located between the upper end 32 and the lower end 31 of base portion 30. Thus, when electrical power is supplied to the heating element (e.g. utilizing switch 39) and the air impeller 25 is made to continuously rotate, ambient air is drawn through the volute air-intake portion (21) and is impelled to heating element 15 and emerges out the barrel as a hotair bath (13) suitable for drying the hair of the user maintaining airbath directional control with the handle 40. The disclosure of this and the immediately preceeding paragraph represent teachings of U.S. Pat. No. 3,610,881 (Stewart-Oct. 5, 1971).

Drawing FIG. 2 is a perspective view of a typical miniature portable radio receiver "PR" of the prior art conventionally including radio frequency and volume control means (e.g. control knobs "C1" and "C2"), sound-emission means (e.g. speaker "S"), and a receptor (e.g. "E") for a powerplug (e.g. "F"). However, some miniature radios lack such elements "E" and "F" (instead being internally provided with batteries), and such battery powered radios are deemed equivalent to "PR" for the purposes of the present invention.

It is substantially impossible for a user of a typical hand-held hair dryer (e.g. "PD") to simultaneously manually hold a portable radio receiver (e.g. "PR") at ear level for the purposes of ameliorating the hair drying and simultaneous hair combing tasks with the pleasant accompaniment of music or other radio entertainment.

OBJECT OF THE INVENTION

It is the general objective of the present invention to incorporate a conventional prior art portable radio receiver (e.g. "PR") into a conventional hand-held hair dryer (e.g. "PD"), yet without any interference to the hair dryer outlet-end, heating element, air-intake volute, nor to the rotating impeller, whereby the user of a hand-held hair dryer might have the benefit of nearby radio receiver entertainment to ameliorate the lengthy and tedious hair drying task.

GENERAL STATEMENT OF THE INVENTION

With the above general objective in view, and together with other specific objectives which will become apparent as this specification proceeds, the hand-held hair dryer having housed radio receiver generally comprises modifying a typical prior art hand-held hair dryer only at the longitudinally extending tubular base portion and marginally at the handle portion, and including: drastically increasing the longitudinal length of the tubular base portion, and changing the cross-sectional shape from circular to rectangular or other noncircular tubular cross-sectional shape; providing window means in such lengthened noncircular tubular base portion and positioned in registry with the control means and sound-emission means of a prior art radio receiver housed therewithin; providing secure seating means for the radio receiver housed within such lengthened and windowed noncircular tubular base portion; and together with other ancillary modifications of relatively minor natures.

BRIEF DESCRIPTION OF THE DRAWING

In the drawing, wherein like characters refer to like parts in the several views, and in which:

FIG. 1 (aforedescribed) relates to a typical hand-held hair dryer "PD" of the prior art;

FIG. 2 (aforedescribed) relates to a typical portable radio receiver of the prior art;

FIG. 3 is an elevational view (similar to FIG. 1) of a representative embodiment "DR" hand-held hair dryer having housed radio receiver and based upon the FIG. 2 radio receiver installed as is within a FIG. 1 type prior art hair dryer wherein only those portions located below the volute air modified for the purposes of embodiment "DR";

FIG. 4 is an elevational view (partly in section) taken along line 4—4 of FIG. 3; and FIG. 5 is a sectional plan view taken along line 5—5 of FIG. 3.

DETAILED DESCRIPTION OF THE DRAWING

The FIGS. 3–5 representative embodiment "DR" of the hand-held hair dryer having housed radio receiver utilizes a prior art radio receiver (e.g. "PR") as is and emplanted within a prior art hand-held hair dryer (e.g. "PD"). Such emplantation is remote from the heated barrel and from the air-intake volute, and specifically is below the volute and the tubular base leadward-end 32. However, due to the very short dimensional length "BL", the circular cross-sectional shape, and other inadequacies for prior art driers at their tubular base portion (e.g. 30), seemingly impossible obstacles would loom against anyone who might perhaps conceive the novel general concept of combining prior art hair dryers and radio receivers into a single portable unit.

The obstacles alluded to in the immediately preceeding paragraph have been overcome herein by modifying prior art hair dryers of the type shown in FIG. 1 at their tubular base portion (e.g. 30) as follows. First, the longitudinal length (indicated as "TL" in FIG. 3) has been drastically increased whereby the ratio of "TL" to "BL" exceeds two. Second, the prior art circular cross-sectional shape must and is replaced by a polygonal or other non-circular cross-sectional shape; this modified shape commences at the tubular base lower (e.g. 61) and extends for a major portion (e.g. "TL") of such lengthened tubular base (e.g. 60). Third, the drastically lengthened and noncircularly cross-sectionally tubular base portion (e.g. 60) must and is provided with sideward window means (e.g. 66, 67, 68) in positionable registry with the control means (e.g. "C1", "C2") and with the sound-emission means (e.g. "S") of the housed radio receiver (e.g. "PR"). Fourth, such lengthened, noncircular, and windowed tubular base portion (e.g. 60) desireably includes seating means (e.g. 62J, 63J) for cradling the housed prior art radio receiver (e.g. "PR").

The several modifications recited in the immediately preceeding paragraph are embodied into the tubular base member shown as 60 and having a regular rectangular cross-sectional shape for major longitudinal length "TL" and including therealong four substantially planar sidewalls (61–65), two of which are substantially parallel broader base-sides (62, 63) flanking longitudinal-axis 30A. For the required sideward window means, base-side 62 has: circular window opening 66 in positioned registry with housed radio control knob "C1"; circular window opening 67 in positioned registry with housed radio control knob "C2"; and rectangular window opening 68 in positioned registry with housed radio sound-emission speaker "S". For the seating means, one or both of the base-sides is provided with indentation means. Such indentation means might take the form of a generally C-shaped indentation 62J in base-side 62. Preferably also, the opposed base-side 63 is provided with a similar C-shaped indentation 63J, whereby the two resultant opposed indentations 62J and 63J cooperate to provide a secure cradling seat for the housed radio receiver "PR".

Appropriate to the noncircular cross-sectional shape for the tubular base major length "TL", the tubular handle (70) differs from the prior art tubular handle 40 in having a noncircular cross-sectional shape at the handle upper end 71. In this vein, noncircular tubular handle embodiment 70 has a rectangular cross-sectional shape at its upper end 71 and which is securely surrounded and thereby attached to the tubular base 60 adjacent its lower end 61.

Similarly to the prior art, and as best indicated in FIG. 4, the noncircularly tubular base portion 60 is aptly provideable in two halves, each half having an abuttable ear 34 and two such ears being joinable by a said screw 9. The juncture between the two base portion halves at side panel 65 might include an opening 69 exposing prior art radio receptor "E", though such opening 69 is obviously unnecessary if the housed radio receiver is of the internally powered battery type.

Thus, it can be seen that the foregoing disclosure provides a hand-held hair dryer having internally housed radio receiver meeting the objectives recited hereabove.

From the foregoing, the construction and operation of the hand-held hair dryer having housed radio receiver will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. Improved hand-held hair drier comprising:

(A) an elongated tubular barrel portion having an outlet-end and an inlet-end, said barrel between said ends being internally provided with a heating element means of the high-resistance electrical conductor type;

(B) a hollow volute portion attached to and communicating with said tubular barrel inlet-end, said volute being internally provided with a rotatable impeller and having air-intake means, whereby impeller rotation causes ambient air to be drawn into the air-intake means and driven through the heating element means and ultimately out the barrel outlet-end as a hotair bath for drying the user's hair;

(C) an elongated tubular base portion extending transversely to the longitudinal axis of the barrel and having an upper end attached to said volute and a lower end located remotely from said volute, the major portion of the length of said tubular base having a substantially rectangular cross sectional shape including a pair of substantially parallel opposed base-sides, said opposed base-sides being provided with substantially mirror image indentations cooperating to provide a secure seat adapted to cradle a conventional portable radio receiver, and at least one of said base-sides being provided with window means; and (D) a conventional portable radio receiver comprising control and sound-emission means, said radio receiver being stably seated within the said opposed indented portions of said base-sides, and the radio receiver control and sound-emission means being positioned in registry with said base portion window means.

2. The structure of claim 1 wherein the respective base-sides indentations are of substantially C-shaped configuration.

* * * * *